US008379868B2

(12) United States Patent
Goodwin et al.

(10) Patent No.: US 8,379,868 B2
(45) Date of Patent: Feb. 19, 2013

(54) SPATIAL AUDIO CODING BASED ON UNIVERSAL SPATIAL CUES

(75) Inventors: Michael Goodwin, Scotts Valley, CA (US); Jean-Marc Jot, Aptos, CA (US)

(73) Assignee: Creative Technology Ltd, Singapore (SG)

( * ) Notice: Subject to any disclaimer, the term of this patent is extended or adjusted under 35 U.S.C. 154(b) by 1152 days.

(21) Appl. No.: 11/750,300

(22) Filed: May 17, 2007

(65) Prior Publication Data

US 2007/0269063 A1 Nov. 22, 2007

Related U.S. Application Data

(60) Provisional application No. 60/747,532, filed on May 17, 2006.

(51) Int. Cl.
*H04R 5/00* (2006.01)

(52) U.S. Cl. ..... 381/17; 381/22; 381/23; 704/500; 704/501; 704/504; 704/200; 704/200.1; 704/E19.005

(58) Field of Classification Search ..... 381/1, 17–18, 381/310, 22–23; 704/200, 200.1, 222, 504, 704/500–501, E19.005
See application file for complete search history.

(56) References Cited

U.S. PATENT DOCUMENTS

| | | | | |
|---|---|---|---|---|
| 3,777,076 | A | 12/1973 | Takahashi | |
| 5,632,005 | A | 5/1997 | Davis et al. | |
| 5,633,981 | A * | 5/1997 | Davis | 704/230 |
| 5,857,026 | A | 1/1999 | Scheiber | |
| 5,890,125 | A | 3/1999 | Davis et al. | |
| 6,487,296 | B1 | 11/2002 | Allen et al. | |
| 6,684,060 | B1 | 1/2004 | Curtin | |
| 7,412,380 | B1 | 8/2008 | Avendano et al. | |
| 7,853,022 | B2 | 12/2010 | Thompson et al. | |
| 7,965,848 | B2 | 6/2011 | Villemoes et al. | |
| 7,970,144 | B1 | 6/2011 | Avendano et al. | |
| 8,081,762 | B2 * | 12/2011 | Ojala et al. | 381/1 |
| 2004/0223622 | A1 | 11/2004 | Lindemann et al. | |
| 2005/0053249 | A1 | 3/2005 | Wu et al. | |
| 2005/0190928 | A1 | 9/2005 | Noto | |
| 2006/0085200 | A1 * | 4/2006 | Allamanche et al. | 704/500 |
| 2006/0106620 | A1 * | 5/2006 | Thompson et al. | 704/500 |
| 2006/0153155 | A1 | 7/2006 | Jacobsen et al. | |
| 2006/0159280 | A1 | 7/2006 | Iwamura | |
| 2007/0087686 | A1 | 4/2007 | Holm et al. | |
| 2007/0211907 | A1 | 9/2007 | Eo et al. | |
| 2007/0242833 | A1 | 10/2007 | Herre et al. | |
| 2007/0269063 | A1 | 11/2007 | Goodwin et al. | |
| 2008/0002842 | A1 | 1/2008 | Neusinger et al. | |
| 2008/0097750 | A1 | 4/2008 | Seefeldt et al. | |
| 2008/0175394 | A1 | 7/2008 | Goodwin | |
| 2008/0205676 | A1 | 8/2008 | Merimaa et al. | |
| 2008/0267413 | A1 | 10/2008 | Faller | |

(Continued)

FOREIGN PATENT DOCUMENTS

WO 2007031896 A1 3/2007

OTHER PUBLICATIONS

Goodwin, M.M. et al., "Primary-Ambient Signal Decomposition and Vector Based Localization for Spatial Audio Coding and Enhancement, "IEEE ICASSP 2007, vol. 1, 15-20, Apr. 2007.

(Continued)

*Primary Examiner* — Disler Paul
(74) *Attorney, Agent, or Firm* — Creative Technology Ltd

(57) ABSTRACT

The present invention provides a frequency-domain spatial audio coding framework based on the perceived spatial audio scene rather than on the channel content. In one embodiment, time-frequency spatial direction vectors are used as cues to describe the input audio scene.

18 Claims, 7 Drawing Sheets

U.S. PATENT DOCUMENTS

| | | | |
|---|---|---|---|
| 2009/0067640 | A1 | 3/2009 | McCarty et al. |
| 2009/0081948 | A1 | 3/2009 | Banks et al. |
| 2009/0129601 | A1 | 5/2009 | Ojala et al. |
| 2009/0150161 | A1 | 6/2009 | Faller |
| 2009/0198356 | A1 | 8/2009 | Goodwin et al. |
| 2010/0296672 | A1 | 11/2010 | Vickers |

OTHER PUBLICATIONS

Christof Faller, 'Parametric Coding of Spatial Audio', Proc. of the 7th Int. Conf. DAFx'04, Napoles, Italy, Oct. 5-8, 2004.

* cited by examiner (a) Gerzon vector (b) Modified vector

Standard 5-channel format

Arbitrary 6-channel format

*Fig._10A*
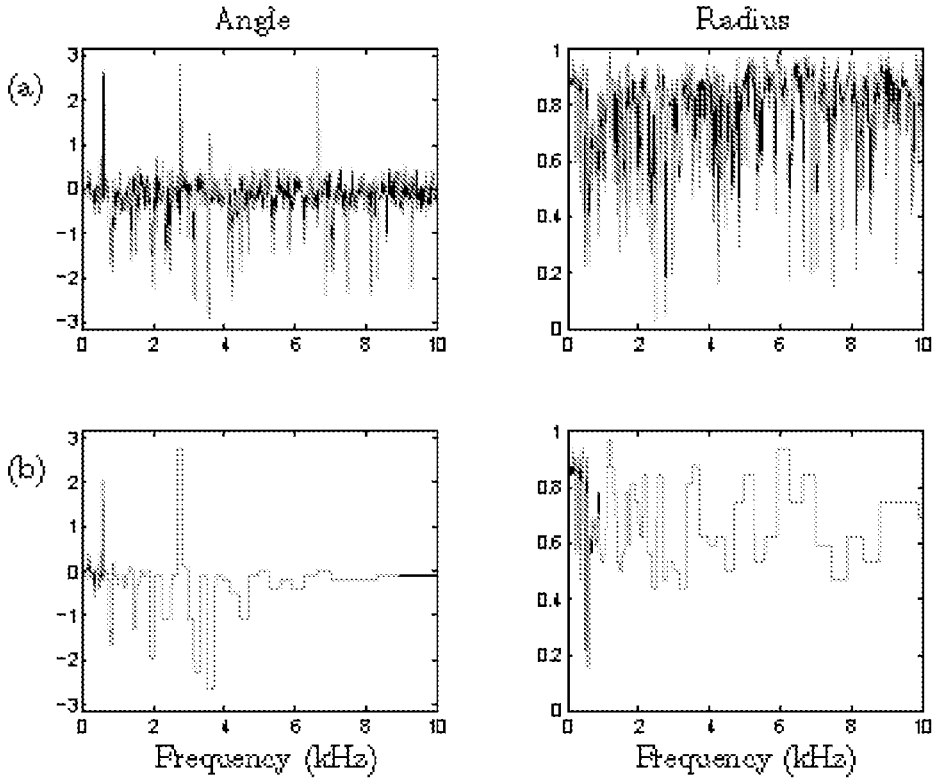
*Fig._10B*
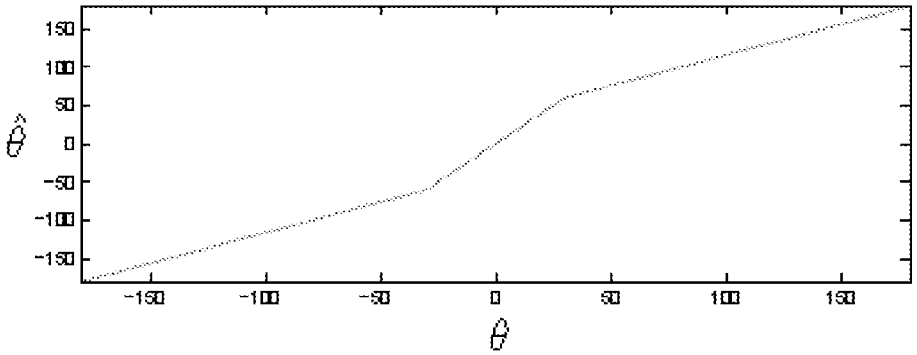
*Fig._12*

SPATIAL AUDIO CODING BASED ON UNIVERSAL SPATIAL CUES

CROSS-REFERENCES TO RELATED APPLICATIONS

This application claims priority from provisional U.S. Patent Application Ser. No. 60/747,532, filed May 17, 2006, titled "Spatial Audio Coding Based on Universal Spatial Cues" the disclosure of which is incorporated by reference in its entirety.

FIELD OF THE INVENTION

The present invention relates to spatial audio coding. More particularly, the present invention relates to using spatial audio coding to represent multi-channel audio signals.

BACKGROUND OF THE INVENTION

Spatial audio coding (SAC) addresses the emerging need to efficiently represent high-fidelity multichannel audio. The SAC methods previously described in the literature involve analyzing the input audio for inter-channel relationships, encoding a downmix signal with these relationships as side information, and using the side data at the decoder for spatial rendering. These approaches are channel-centric or format-centric in that they are generally designed to reproduce the input channel content over the same output channel configuration.

It is desirable to provide improved spatial audio coding that is independent of the input audio channel format or output audio channel configuration.

SUMMARY OF THE INVENTION

The present invention provides a frequency-domain spatial audio coding framework based on the perceived spatial audio scene rather than on the channel content. In one embodiment, a method of processing an audio input signal is provided. An input audio signal is received. Time-frequency spatial direction vectors are used as cues to describe the input audio scene. Spatial cue information is extracted from a frequency-domain representation of the input signal. The spatial cue information is generated by determining direction vectors for an audio event from the frequency-domain representation.

In accordance with another embodiment, an analysis method is provided for robust estimation of these cues from arbitrary multichannel content. In accordance with yet another embodiment, cues are used to achieve accurate spatial decoding and rendering for arbitrary output systems.

These and other features and advantages of the present invention are described below with reference to the drawings.

BRIEF DESCRIPTION OF THE DRAWINGS

FIG. 10 is a diagram illustrating raw and data-reduced spatial cues in accordance with one embodiment of the present invention.

FIG. 12 is a diagram illustrating a mapping function for modifying angle cues to achieve a widening effect in accordance with one embodiment of the present invention.

DETAILED DESCRIPTION OF PREFERRED EMBODIMENTS

It should be noted that the material attached hereto as appendices or exhibits are incorporated by reference into this description as if set forth fully herein and for all purposes.

Reference will now be made in detail to preferred embodiments of the invention. Examples of the preferred embodiments are illustrated in the accompanying drawings. While the invention will be described in conjunction with these preferred embodiments, it will be understood that it is not intended to limit the invention to such preferred embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well known mechanisms have not been described in detail in order not to unnecessarily obscure the present invention.

It should be noted herein that throughout the various drawings like numerals refer to like parts. The various drawings illustrated and described herein are used to illustrate various features of the invention. To the extent that a particular feature is illustrated in one drawing and not another, except where otherwise indicated or where the structure inherently prohibits incorporation of the feature, it is to be understood that those features may be adapted to be included in the embodiments represented in the other figures, as if they were fully illustrated in those figures. Unless otherwise indicated, the drawings are not necessarily to scale. Any dimensions provided on the drawings are not intended to be limiting.

Figure 15:
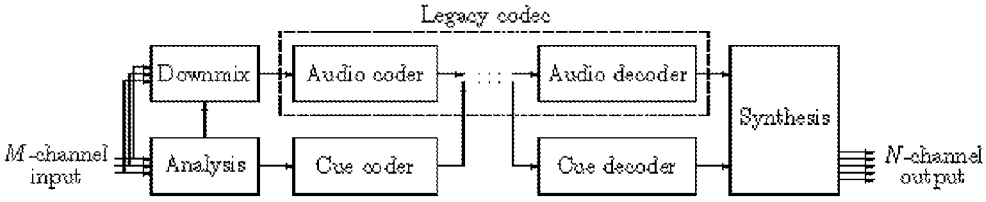
FIG. 15 depicts a generalized spatial audio coding system.

Recently, spatial audio coding (SAC) has received increasing attention in the literature due to the proliferation of multichannel content and the need for effective bit-rate reduction schemes to enable efficient storage and transmission of this content. The various methods proposed involve a number of common steps: analyzing the set of input audio channels for spatial relationships; downmixing the input audio, perhaps based on the spatial analysis; coding the downmix, typically with a legacy method for the sake of backwards compatibility; incorporating spatial side information in the coded representation; and, using the side information for spatial rendering at the decoder, if it supports such processing. FIG. 15 depicts a generalized SAC system with these components. In a typical system, the spatial side information is packed with the coded downmix for transmission or storage.

Spatial audio coding methods previously described in the literature are channel-centric in that the spatial side information consists of inter-channel signal relationships such as level and time differences, e.g. as in binaural cue coding (BCC). Furthermore, the codecs are designed primarily to reproduce the input audio channel content using the same output channel configuration. To avoid mismatches introduced when the output configuration does not match the input and to enable robust rendering on arbitrary output systems, the SAC framework described in various embodiments of the present invention uses spatial cues which describe the perceived audio scene rather than the relationships between the input audio channels.

Embodiments of the present invention relate to spatial audio coding based on cues which describe the actual audio scene rather than specific inter-channel relationships. Provided in various embodiments is a frequency-domain SAC framework based on channel- and format-independent positional cues. Hence, one key advantage of these embodiments is a generic spatial representation that is independent of the number of input channels, the number of output channels, the input channel format, or the output loudspeaker layout.

A spatial audio coding system in accordance with one embodiment operates as follows. The input is a set of audio signals and corresponding contextual spatial information. The input signal set in one embodiment could be a multichannel mix obtained with various mixing or spatialization techniques such as conventional amplitude panning or Ambisonics; or, alternatively, it could be a set of unmixed monophonic sources. For the former, the contextual information comprises the multichannel format specification, namely standardized speaker locations or channel definitions, e.g. channel angles $\{0°, -30°, 30°, -110°, 110°\}$ for a standard 5-channel format; for the latter, it comprises arbitrary positions based on sound design or some interactive control, for example, in a game environment where a sound source is programmatically positioned at a specific location in the game scene. In the analysis, the input signals are transformed into a frequency-domain representation wherein spatial cues are derived for each time-frequency tile based on the signal relationships and the original spatial context. When a given tile corresponds to a single spatially distinct audio source, the spatial information of that source is preserved by the analysis; when the tile corresponds to a mixture of sources, an appropriate combined spatial cue is derived. These cues are coded as side information with a downmix of the input audio signals. At the decoder, the cues are used to spatially distribute the downmix signal so as to accurately recreate the input audio scene. If the cues are not provided or the decoder is not configured to receive the cues, in one embodiment a consistent blind upmix is derived and rendered by extracting partial cues from the downmix itself.

Initially, the fundamental design goals of a "universal" spatial audio coding system are discussed. It should be noted that these design goals are intended to be illustrative as to preferred properties in preferred embodiments but are not intended to limit the scope of the invention.

Note that the term frequency-domain is used as a general descriptor of the SAC framework. We focus on the use of the short-time Fourier transform (STFT) for signal decomposition in the spatial analysis, but the methods described in embodiments of the present invention are applicable to other time-frequency transformations, filter banks, signal models, etc. Throughout the description, we use the term bin to describe a frequency channel or subband of the STFT, and the term tile to describe a localized region in the time-frequency plane, e.g. a time interval within a subband. In this description, we are concerned with the general case of analyzing an M-channel input signal, coding it as a downmix with spatial side information, and rendering the decoded audio on an arbitrary N-channel reproduction system.

This generality gives rise to a number of preferred design goals for the system components as discussed further herein. A primary design goal of the inventive SAC framework is that the spatial side information provides a physically meaningful description of the perceived audio scene. In a preferred embodiment, the spatial information includes at least one and more preferably all of the following properties: independence from the input and output channel configurations; independence from the spatial encoding and rendering techniques; preservation of the spatial cues of both point sources and distributed sources, including ambience "components"; and for a spatially "stable" source, stability in the encode-decode process.

In embodiments of the present invention, time-frequency spatial direction vectors are used to describe the input audio scene. These cues may be estimated from arbitrary multichannel content using the inventive methods described herein. These cues, in several embodiments, provide several advantages over conventional spatial cues. By using time-frequency direction vectors, the cues describe the audio scene, i.e. the location and spatial characteristics of sound events (rather than channel relationships, for example), and are independent of the channel configuration or spatial encoding technique. That is, they have universality. Further, these cues are complete, i.e., they capture all of the salient features of the audio scene; the spatial percept of any potential sound event is representable by the cues. In preferred embodiments, the spatial cues are selected so as to be amenable to extensive data reduction so as to minimize the bit-rate overhead of including the side information in the coded audio stream (i.e., compactness).

In one embodiment, the spatial cues possess consistency, i.e., an analysis of the output scene should yield the same cues as the input scene. Consistency becomes increasingly important in tandem coding scenarios; it is obviously desirable to preserve the spatial cues in the event that the signal undergoes multiple generations of spatial encoding and decoding.

The literature on spatial audio coding systems has covered the use of both mono and stereo downmixes for capturing the audio source content. Recently, stereo downmix has become prevalent so as to preserve compatibility with standard stereo playback systems. Both cases are described. However, the scope of the invention is not limited to these types of downmixes. Rather, the scope includes without limitation any type of downmix such as might be used for efficient storage or transmission or to further enable robust or enhanced reproduction.

Preferably, the downmix provides acceptable quality for direct playback, preserves total signal energy in each tile and the balance between sources, and preserves spatial information. Prior to encoding (for data reduction of the downmixed audio), the quality of a stereo downmix should be comparable to an original stereo recording.

For the mono case, the requirements for the downmix are an acceptable quality for the mono signal and a basic preservation of the signal energy and balance between sources. The key distinction is that spatial cues can be preserved to some extent in a stereo downmix; a mono downmix must rely on spatial side information to render any spatial cues.

In one embodiment, to be described in further detail later in this description, a method for analyzing and encoding an input audio signal is provided. The analysis method is preferably extensible to any number of input channels and to arbitrary channel layouts or spatial encoding techniques. Preferably still, the analysis method is amenable to real-time implementation for a reasonable number of input channels; for non-streaming applications, real-time implementation is not necessary, so a larger number of input channels could be analyzed in such cases. In preferred embodiments, the analysis block is provided with knowledge of the input spatial context and adapts accordingly. Note that the last item is not limiting with respect to universality since the input context is used only for analysis and not for synthesis, i.e. the synthesis doesn't require any information about the input format.

In one embodiment, the transformation or model used by the analysis achieves separation of independent sources in the signal representation. Some blind source separation algorithms rely on minimal overlap in the time-frequency representation to extract distinct sources from a multichannel mix. Complete source separation in the analysis representation is not essential, though it might be of interest for compacting the spatial cue data. Overlapping sources simply yield a composite spatial cue in the overlap region; the scene analysis of the human auditory system is then responsible for interpreting the composite cues and constructing a consistent understanding of the scene.

The synthesis block of the universal spatial audio coding system of the present invention embodiments is responsible for using the spatial side information to process and redistribute the downmix signal so as to recreate the input audio scene using the output rendering format. A preferred embodiment of the synthesis block provides several desirable properties. The rendered output scene should be a close perceptual match to the input scene. In some cases, e.g. when the input and output formats are identical, exact signal-level equivalence should be achieved for some test signals. Spatial analysis of the rendered scene should yield the same spatial cues used to generate it; this corresponds to the consistency property discussed earlier. The synthesis algorithm should not introduce any objectionable artifacts. The synthesis algorithm should be extensible to any number of output channels and to arbitrary output formats or spatial rendering techniques. The algorithm must admit real-time implementation on a low-cost platform (for a reasonable number of channels). For optimal spatial decoding, the synthesis should have knowledge of the output rendering format, either via automatic measurement or user input, and should adapt accordingly.

Figure 1:
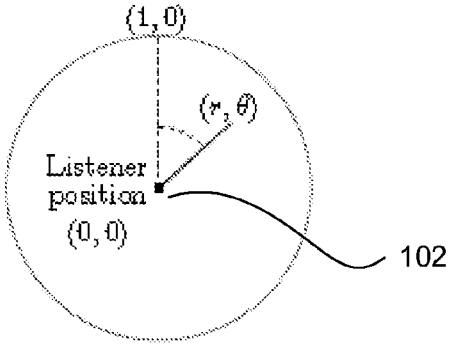
FIG. 1 is a depiction of a listening scenario upon which the universal spatial cues are based.

Note that the last item is not limiting with respect to the system's universality (i.e. format independence of the spatial information) since the output format knowledge is only used in the synthesis stage and is not incorporated in the analysis of the input audio. In accordance with one embodiment, for a spatial audio coding system, a set of spatial cues meeting at least some of the described design objectives is provided. FIG. 1 is a depiction of a listening scenario upon which the universal spatial cues are based. In this general framework, the listener is situated at the center 102 of a unit circle; the spatial aspects of perceived sound events are described with respect to this circle using the polar coordinates $(r,\theta)$, where $0<r<1$ and $-\pi<\theta<\pi$. The case $r=1$, i.e. on the circle, corresponds to a discrete point source at angle $\theta$. Decreasing r corresponds to source positions inside the circle as in a fly-over sound event. The limit $r=0$ defines a non-directional percept; note that at $r=0$ the angle cue $\theta$ is not meaningful.

The coordinates $(r,\theta)$ define a direction vector. We use the $(r,\theta)$ cues on a per-tile basis in a time-frequency domain; we can thus express the cues as $(r[k,l], \mathbf{0}[k,\mathbf{1}])$ where k is a frequency index and l is a time index. Three-dimensional treatment of sources within the sphere would require a third parameter. This extension is straightforward. The proposed $(r,\theta)$ cues satisfy the universality property in that the spatial behavior of sound events is captured without reference to the channel configuration. Completeness is achieved for the two-dimensional listening scenario if the cues can take on any coordinates within or on the unit circle. Furthermore, completeness calls for effective differentiation between primary sources (sometimes referred to as "direct" sources), for which the channel signals are mutually coherent, and ambient sources, for which the channel signals are mutually incoherent; this is addressed by the ambience extraction (primary-ambient separation) approach depicted in FIG. 3 and discussed further herein. With respect to the compactness or sparsity requirement, a scene with few discrete non-overlapping sources yields correspondingly few dominant angles; in the limiting case where there is one discrete point source in the audio scene, $r=1$ for all k and $\theta$ is likewise a constant. Time-frequency overlap of multiple sources and source widening tends to reduce the apparent cue compactness, but the psychoacoustics of spatial hearing enables significant cue compression based on the resolution limits of the auditory system.

For the frequency-domain spatial audio coding framework, several variations of the direction vector cues are provided in different embodiments. These include unimodal, continuous, bimodal primary-ambient with non-directional ambience, bimodal primary-ambient with directional ambience, bimodal continuous, and multimodal continuous. In the unimodal embodiment, one direction vector is provided per time-frequency tile. In the continuous embodiment, one direction vector is provided for each time-frequency tile with a focus parameter to describe source distribution and/or coherence.

In another embodiment, i.e., the bimodal primary-ambient with non-directional ambience, for each time-frequency tile, the signal is decomposed into primary and ambient components; the primary (coherent) component is assigned a direction vector; the ambient (incoherent) component is assumed to be non-directional and is not represented in the spatial cues. A cue describing the direct-ambient energy ratio for each tile is also included if that ratio is not retrievable from the downmix signal (as for a mono downmix). The bimodal primary-ambient with directional ambience embodiment is an extension of the above case where the ambient component is assigned a distinct direction vector.

In a bimodal continuous embodiment, two components with direction vectors and focus parameters are estimated for each time-frequency tile. In a multimodal continuous embodiment, multiple sources with distinct direction vectors and focus parameters are allowed for each tile. While the continuous and multimodal cases are of interest for generalized high-fidelity spatial audio coding, listening experiments suggest that the unimodal and bimodal cases provide a robust basis for a spatial audio coding system.

In preferred embodiments, we thus focus on the unimodal and bimodal cases, wherein the spatial cues consist of (r[k,l], θ[k,l]) direction vectors.

Figure 3:
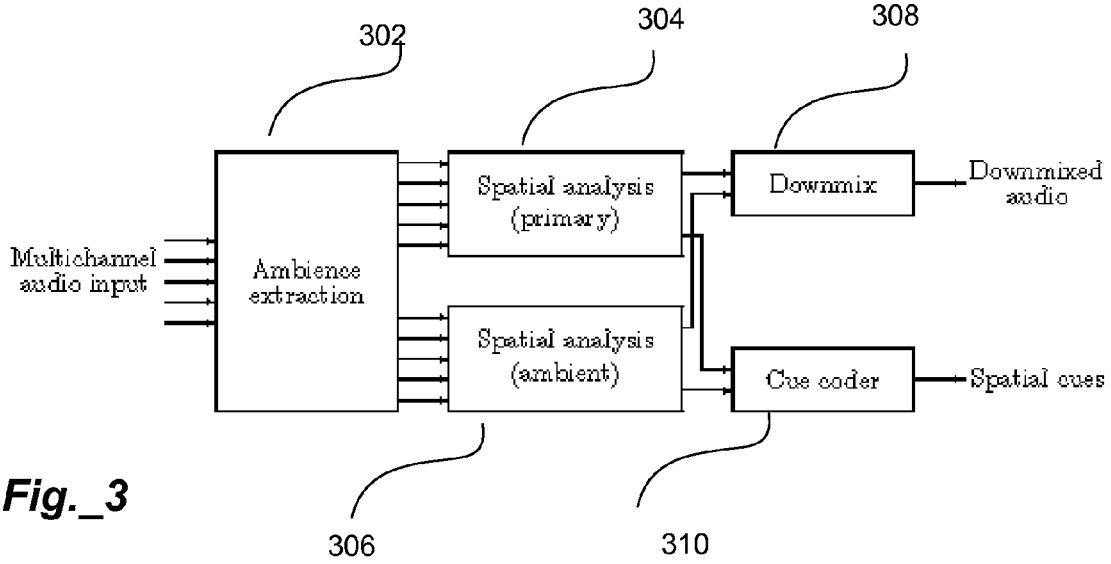
FIG. 3 is a block diagram of a spatial audio encoder for a bimodal primary-ambient case in accordance with one embodiment of the present invention.

FIG. 3 gives a block diagram of a spatial audio encoder based for the bimodal primary-ambient case (with directional ambience) listed above. In block 302, the input audio signal is separated into ambient and primary components; the primary components correspond to coherent sound sources while the ambient components correspond to diffuse, unfocussed sounds such as reverberation or incoherent volumetric sources (such as a swarm of bees). A spatial analysis is carried out on each of these components to extract corresponding spatial cues (blocks 304, 306). The primary and ambient components are then downmixed appropriately (block 308), and the primary-ambient cues are compressed (block 310) by the cue coder. Note that if no ambience extraction is incorporated, the system corresponds to the unimodal case.

Figure 2:
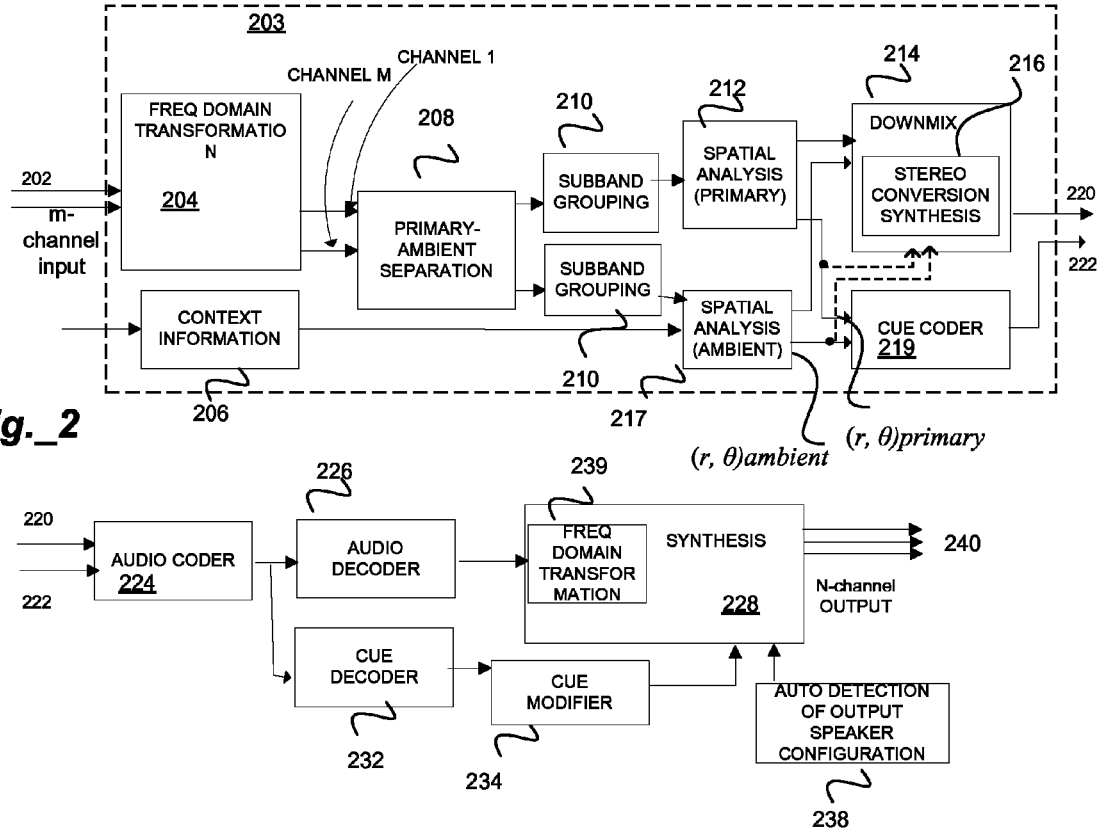
FIG. 2 depicts a generalized spatial audio coding system in accordance with one embodiment of the present invention.

FIG. 2 depicts a spatial audio processing system in accordance with embodiments of the present invention. An input audio signal 202 is spatially coded and downmixed for efficient transmission or storage, represented by intermediate signal 220,222. The spatially coded signal is decoded and synthesized to generate an output signal 240 that recreates the input audio scene using the output channel speaker configuration.

In greater detail, the spatial audio coding system 203 is preferably configured such that the spatial information used to describe the input audio scene (and transmitted as an output signal 220, 222) is independent of the channel configuration of the input signal or the spatial encoding technique used. Further, the audio coding system is configured to generate spatial cues that preferably can be used by a spatial decoding and synthesis system to generate the same spatial information that was derived from the input acoustic scene. These system characteristics are provided by the spatial analysis methods (for example, blocks 212, 217) and synthesis (block 228) methods described and illustrated in this specification.

In further detail, the spatial audio coding 203 comprises a spatial analysis carried out on a time-frequency representation of the input signals. The M-channel input signal 202 is first converted to a frequency-domain representation in block 204 by any suitable method that includes a Short Term Fourier Transform or other transformations described in this specification (general subband filter bank, wavelet filter bank, critical band filter bank, etc.) as well as other alternatives known to those of skill in the relevant arts. This preferably generates, for each input channel separately, a plurality of audio events. The input audio signal helps define the audio scene and the audio event is a component of the audio scene that is localized in time and frequency. For example, by using windowing functions overlapped in time and applying a Short Term Fourier Transform, each channel may generate a collection of tiles, each tile corresponding to a particular time and frequency subband. These generated tiles can be used to represent an audio event on a one-to-one basis or may be combined to generate a single audio event. For example, for efficiency purposes, tiles representing 2 or more adjacent frequency subbands may be combined to generate a single audio event for spatial analysis purposes, such as the processing occurring in blocks 208-212.

The output of the transformation module 204 is fed preferably to a primary-ambience separation block 208. Here each time-frequency tile is decomposed into primary and ambient components. It should be noted that blocks 208, 212, 217 denote an analysis system that generates bimodal primary-ambient cues with directional ambience. This form of cue may be suitable for stereo or multichannel input signals. This is illustrative of one embodiment of the invention and is not intended to be limiting. Further details as to other forms of spatial cues that can be generated are provided elsewhere in this specification. For a non-limiting example, the spatial information (spatial cues) may be unimodal, i.e., determining a perceived location for each spatial event or time frequency tile. The primary-ambient cue options involve separating the input signal representing the audio or acoustic scene into primary and ambient components and determining a perceived spatial location for each acoustic event in each of those classes.

In yet another alternative embodiment, the primary-ambient decomposition results in a direction vector cue for the primary component but no direction vector cue for the ambience component.

Turning to blocks 210, the output signals from the primary-ambient decomposition may be regrouped for efficiency purposes. In general, substantial data reduction may be achieved by exploiting properties of the human auditory system, for example, the fact that auditory resolution decreases with increasing frequencies. Hence, the STFT bins resulting from the transformation in block 204 may be grouped into nonuniform bands. Preferably, this occurs to the signals transmitted at the outputs of block 208, but may be implemented alternatively at the output terminals of block 204.

Next, the acoustic events comprising the individual tiles or alternatively the grouping of subbands generated by the optional subband grouping (blocks 210) are subjected to spatial analysis in blocks 212 and 217. Each signal in the input acoustic scene has a corresponding vector with a direction corresponding to the signal's spatial location and a magnitude corresponding to the signal's intensity or energy. That is, the contribution of each channel to the audio scene is represented by an appropriately scaled direction vector and the perceptual source location is then derived as the vector sum of the scaled channel vectors. The resultant vectors preferably are represented by a radial and an angular parameter. The signal vectors corresponding to the channels are aggregated by vector addition to yield an overall perceived location for the combination of signals.

In one embodiment, in order to ensure that the complete audio scene may be represented by the spatial cues (i.e., a completeness property) the aggregate vector is corrected. The vector is decomposed into a pairwise-panned component and a non-directional or "null" component. The magnitude of the aggregate vector is modified based on the decomposition.

Next, in block 214, the multichannel input signal is downmixed for coding. In one embodiment, all input channels may be downmixed to a mono signal. Preferably, energy preservation is applied to capture the energy of the scene and to counteract any signal cancellation. Further details are provided later in this specification. According to an alternative embodiment, a synthesis processing block 216 enables the derivation of a downmix having any arbitrary format, including for example, stereo, 3-channel, etc. This downmix is generated using the spatial cues generated in blocks 212, 217. Further details are provided in the downmix section of this specification.

Turning back to the input signal 202, it is preferred that some context information 206 be provided to the encoder so that the input channel locations may be incorporated in the spatial analysis.

Turning to block 219, the time-frequency spatial cues are reduced in data rate, in one embodiment by the use of scalable bandwidth subbands implemented in block 219. In a preferred embodiment, the subband grouping is performed in block 210. These are detailed later in the specification.

The downmixed audio signal 220 and the coded cues 22 are then fed to audio coder 224 for standard coding using any suitable data formats known to those of skill in the arts.

In blocks 226,232 through 240 the output signal is generated. Block 226 performs conventional audio decoding with reference to the format of the coded audio signal. Cue decoding is performed in block 232. The cues can also be used to modify the perceived audio scene. Cue modification may optionally be performed in block 234. For instance, the spatial cues extracted from a stereo recording can be modified so as to redistribute the audio content onto speakers outside the original stereo angle range, Spatial synthesis based on the universal spatial cues occurs in block 228.

In block 228, the signals are generated for the specified output system (loudspeaker format) so as to optimally recreate the input scene given the available reproduction resources. By using the methods described, the system preserves the spatial information of the input acoustic scene as captured by the universal spatial cues. The analysis of the synthesized scene yields the same spatial cues used to generate the synthesized scene (which were derived from the input acoustic scene and subsequently encoded/data-reduced). Further, in preferred embodiments, the synthesis block is configured to preserve the energy of the input acoustic scene. In one embodiment, the consistent reconstruction is achieved by a pairwise-null method. This is explained in further detail later in the specification but includes deriving pairwise-panning coefficients to recreate the appropriate perceived direction indicated by the spatial cue direction vector; deriving non-directional panning coefficients that result in a non-directional percept, and cross-fading between the pairwise and non-directional ("null") weights to achieve the correct spatial location. Some positional information about the output loudspeakers is expected by the synthesis algorithm. This could be user-entered or derived automatically (see below).

The output signal is generated at 240.

In an alternative embodiment, the system also includes an automatic calibration block 238. The spatial synthesis system based on universal spatial cues incorporates an automatic measurement system to estimate the positions of the loudspeakers to be used for rendering. It uses this positional information about the loudspeakers to generate the optimal signals to be delivered to the respective loudspeakers so as to recreate the input acoustic scene optimally on the available loudspeakers and to preserve the universal spatial cues.

Spatial Analysis

Figure 4:
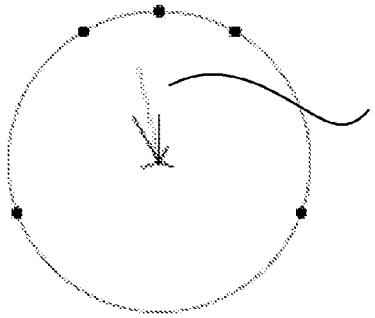
FIG. 4 is a diagram illustrating channel vector summation for a standard five-channel layout in accordance with one embodiment of the present invention.

The direction vectors are based on the concept that the contribution of each channel to the audio scene can be represented by an appropriately scaled direction vector, and the perceived source location is then given by a vector sum of the scaled channel vectors. A depiction of this vector sum 402 is given in FIG. 4 for a standard five-channel configuration, with each node on the circle representing a channel location.

The inventive spatial analysis-synthesis approach uses time-frequency direction vectors on a per-tile basis for an arbitrary time-frequency representation of the multichannel signals; specifically, we use the STFT, but other representations or signal models are similarly viable. In this context, the input channel signals $x_m[t]$ are transformed into a representation $X_m[k,l]$ where k is a frequency or bin index; l is a time index; and m is the channel index. In the following, we treat the case where the $x_m[t]$ are speaker-feed signals, but the analysis can be extended to multichannel scenarios wherein the spatial contextual information does not correspond to physical channel positions but rather to a multichannel encoding format such as Ambisonics.

Given the transformed signals, the directional analysis is carried out as follows.

First, the channel configuration or source positions, i.e. the spatial context of the input audio channels, is described using unit vectors ($\vec{p}_m$) pointing to each channel position. Each input channel signal has a corresponding vector with a direction corresponding to the signal's spatial location and a magnitude corresponding to the signal's intensity or energy. If θ is assumed to be θ at the front center position (the top of the circle in FIG. 1) and positive in the clockwise direction, the rectangular coordinates are $\vec{p}_m=[\sin\theta_m \cos\theta_m]^T$ where $\theta_m$ is the clockwise angle of the m-th input channel. Then, the direction vector sum is computed as $$\vec{g}[k,l]=\sum_m \alpha_m[k,l]\vec{p}_m \tag{1}$$

where the coefficients in the sum are given by $$\alpha_m[k,l]=\frac{|X_m[k,l]|^2}{\sum_{i=1}^{M}|X_i[k,l]|^2} \tag{2}$$

This is referred to as an energy sum. Preferrably, the $\alpha_m$ are normalized such that $\Sigma\Sigma_m\alpha_m=1$ and furthermore that $0\leqq\alpha_m\leqq 1$. Alternate formulations such as
may be used in other embodiments, however the energy sum provides the preferred $$\alpha_m[k,l]=\frac{|X_m[k,l]|}{\sum_{i=1}^{M}|X_i[k,l]|} \tag{3}$$

method due to power preservation considerations. Note that all of the terms in Eqs. (1)-(3) are functions of frequency k and time l; in the remainder of the description, the notation will be simplified by dropping the [k,l] indices on some variables that are time and frequency dependent. In the remainder of the description, the energy sum vector established in Eqs. (1)-(2) will be referred to as the Gerzon vector, as it is known as such to those of skill in the spatial audio community.

Figure 5A:
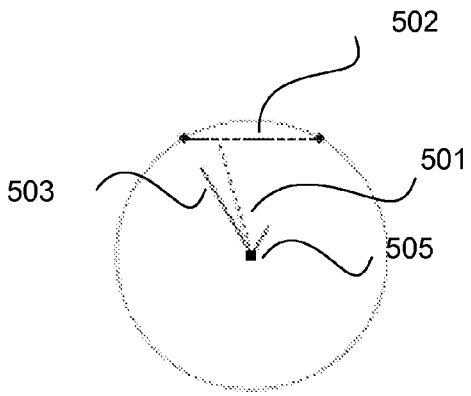
FIG. 5 is a diagram illustrating direction vectors for pairwise-panned sources in accordance with one embodiment of the present invention.

In one embodiment, a modified Gerzon vector is derived. The standard Gerzon vector formed by vector addition to yield an overall perceived spatial location for the combination of signals may in some cases need to be corrected to approach or satisfy the completeness design goal. In particular, the Gerzon vector has a significant shortcoming in that its magnitude does not faithfully describe the radial location of discrete pairwise-panned sources. In the pairwise-panned case, for instance, the so-called encoding locus of the Gerzon vector is bounded by the inter-channel chord as depicted in FIG. 5A, meaning that the radius is underestimated for pairwise-panned sources, except in the hard-panned case where the direction exactly matches one of the directional unit channel vectors. Subsequent decoding based on the Gerzon vector magnitude will thus not render such sources accurately.

To correct the representation of pairwise-panned sources, the Gerzon vector can be rescaled so that it always has unit magnitude.

$$\vec{d} = \frac{\vec{g}}{\|\vec{g}\|} \tag{4}$$

FIG. 5 is a diagram illustrating direction vectors for pairwise-panned sources in accordance with embodiments of the present invention.

Figure 5B:
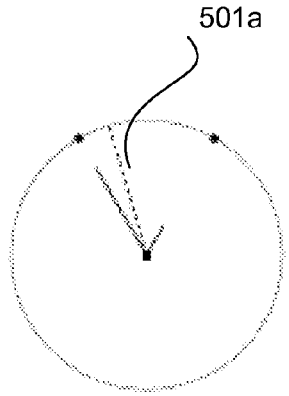

As illustrated in FIG. 5, the Gerzon vector 501 specified in Eqs. (1)-(2) is limited in magnitude by the dotted chord 502 shown in FIG. 5A. FIG. 5B shows the modification of Eq. (4) resealing the vector 501 to unit magnitude (r=1) for pairwise-panned sources.

It is straightforward to derive a closed-form expression for this resealing:

$$\vec{d} = \Gamma(\alpha_i, \alpha_j, \theta_j - \theta_i)\vec{g} \tag{5}$$

$$\Gamma(a_i, a_j, \theta) = \frac{a_i + a_j}{[a_i^2 + a_j^2 + 2a_i a_j \cos\theta]^{\frac{1}{2}}} = \|\vec{g}\|^{-1}$$

In Eq. (5), $\alpha_i$ and $\alpha_j$ are the weights for the channel pair in the vector summation of Eq. (1); $\theta_i$ and $\theta_j$ are the corresponding channel angles. As illustrated in FIG. 5B, this correction rescales the direction vector to achieve unit magnitude for discrete pairwise-panned sources. For the limited case of pairwise panning in a two-channel encoding, the resealing modification of Eq. (4) corrects the Gerzon vector magnitude and is a viable approach.

Figure 6:
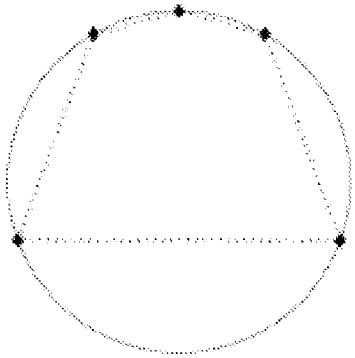
FIG. 6 is a diagram illustrating input channel formats (diamonds) and the corresponding encoding loci of the Gerzon vector in accordance with one embodiment of the present invention.
Figure 6:
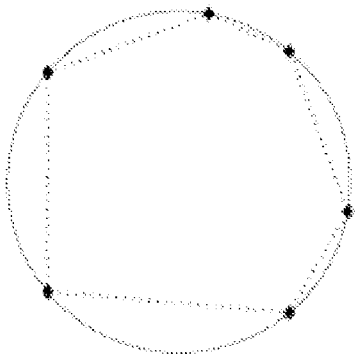

In multichannel embodiments (more than two channels) a resealing method is desired to accommodate universality or completeness concerns. FIG. 6 depicts input channel formats (diamonds) and the corresponding encoding loci (dotted) of the Gerzon vector specified in Eq. (1). For a given channel format, the encoding locus of the Gerzon vector is an inscribed polygon with vertices at the channel vector endpoints. In an alternative multichannel embodiment, a robust Gerzon vector resealing results from decomposing the vector into a directional component and a non-directional component. Consider again the unit channel vectors $\vec{p}_m$. The unmodified Gerzon vector $\vec{g}$ is simply a weighted sum of these vectors with $\Sigma_m \alpha_m=1$ as specified in Eqs. (1)-(2). The vector sum can be equivalently expressed in matrix form as $$\vec{g}=P\vec{\alpha} \tag{8}$$

where the m-th column of the matrix P is the channel vector $\vec{p}_m$. Note that P is of rank two for a planar channel format (if not all of the channel vectors are coincident or colinear) or of rank three for three-dimensional formats.

Since the format matrix P is rank-deficient (when the number of channels is sufficiently large as in typical multichannel scenarios), the direction vector $\vec{g}$ can be decomposed as $$\vec{g}=P\vec{\alpha}=P\vec{\rho}+P\vec{\epsilon} \tag{9}$$

where $\vec{\alpha}=\vec{\rho}+\vec{\epsilon}$ and where the vector $\vec{\epsilon}$ is in the null space of P, i.e. $P\vec{\epsilon}=0$ with $\|p\|_2>0$. Of the infinite number of possibilities here, there is a uniquely specifiable decomposition of particular value for our application: if the coefficient vector $\vec{\rho}$ is chosen to only have nonzero elements for the channels which are adjacent (on either side) to the vector $\vec{g}$, the resulting decomposition gives a pairwise-panned component with the same direction as $\vec{g}$ and a non-directional component whose Gerzon vector sum is zero. Denoting the channel vectors adjacent to $\vec{g}$ as $\vec{p}_i$ and $\vec{p}_j$, we can write:

$$\begin{bmatrix} \rho_i \\ \rho_j \end{bmatrix} = [\,\vec{p}_i \quad \vec{p}_j\,]^{-1}\vec{g} \tag{10}$$

where $\rho_i$ and $\rho_j$ are the nonzero coefficients in $\vec{\rho}$, which correspond to the i-th and j-th channels. Here, we are finding the unique expansion of $\vec{g}$ in the basis defined by the adjacent channel vectors; the remainder $\vec{\epsilon}=\vec{\alpha}-\vec{\rho}$ is in the null space of P by construction.

Figures 7A, 7B, 7C:
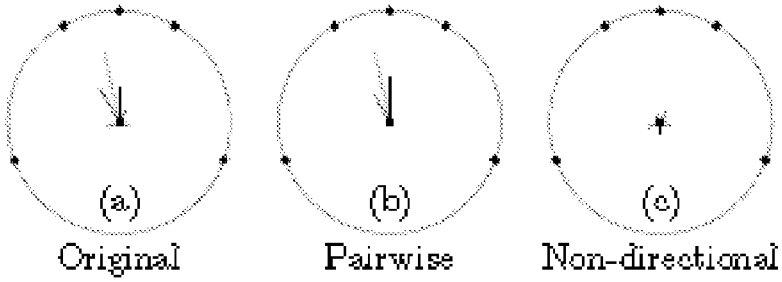
FIG. 7 is a diagram illustrating direction vector decomposition into a pairwise-panned component and a non-directional component in accordance with one embodiment of the present invention.

An example of the decomposition is shown in FIG. 7. That is, FIG. 7 illustrates a direction vector decomposition into a pairwise-panned component and a non-directional component in accordance with one embodiment. FIG. 7A shows the scaled channel vectors and Gerzon direction vector from FIG. 4. FIGS. 7B and 7C show the pairwise-panned and non-directional components, respectively, according to the decomposition specified in Eqs. (9) and (10).

Given the decomposition into pairwise and non-directional components, the norm of the pairwise coefficient vector $\vec{\rho}$ can be used to provide a robust resealing of the Gerzon vector:

$$\vec{d} = \|\vec{\rho}\|_1\left(\frac{\vec{g}}{\|\vec{g}\|}\right) \tag{11}$$

In this formulation, the magnitude of $\vec{\rho}$ indicates the radial sound position. The boundary conditions meet the desired behavior: when $\|\vec{\rho}\|_1=0$, the sound event is non-directional and the direction vector $\vec{d}$ has zero magnitude; when $\|\vec{\rho}\|_1=1$, as is the case for discrete pairwise-panned sources, the direction vector $\vec{d}$ has unit magnitude. This direction vector, then, unlike the Gerzon vector, satisfies the completeness and universality constraints. Note that in the above we are assuming that the weights in $\vec{\rho}$ are energy weights, such that $\|\vec{\rho}\|_1=1$ for a discrete pairwise-panned source as in standard panning methods; this assumption is consistent with our use of the energy sum in Eq. (2) to determine the coefficients $\vec{\alpha}$.

Figure 8:
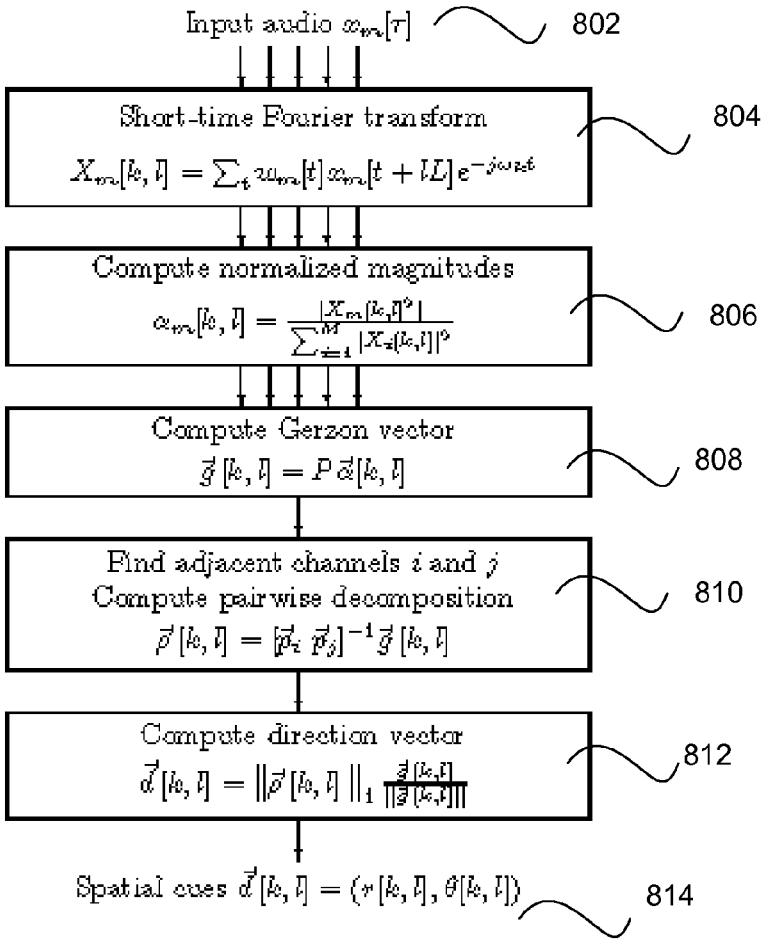
FIG. 8 is a flow chart of the spatial analysis algorithm used in a spatial audio coder in accordance with one embodiment of the present invention.

The angle and magnitude of the resealed vector in Eq. (11) are computed for each time-frequency tile in the signal representation; these are used as the (r[k,l], θ[k,l]) spatial cues in the proposed SAC system in the unimodal case. FIG. 8 is a flow chart of the spatial analysis method for the unimodal case in a spatial audio coder in accordance with one embodiment of the present invention. The method begins at operation 802 with the receipt of an input audio signal. In operation 804, a Short Term Fourier Transform is preferably applied to transform the signal data to the frequency domain. Next, in operation 806, normalized magnitudes are computed at each time and frequency for each of the input channel signals. A Gerzon vector is then computed in operation 808, as in Eq. (1). In operation 810, adjacent channels i and j are determined and a pairwise decomposition is computed. In operation 812, the direction vector is computed . Finally, at operation 814, the spatial cues are provided as output values.

Separation of Primary and Ambient Components

It is often advantageous to separate primary and ambient components in the representation and synthesis of an audio scene. While the synthesis of primary components benefits from focusing the reproduced sound energy over a localized set of loudspeakers, the synthesis of ambient components preferably involves a different sound distribution strategy aiming at preserving or even extending the spread of sound energy over the target loudspeaker configuration and avoiding the formation of a spatially focused perceived sound event. In the representation of the audio scene, the separation of primary and ambient components may enable flexible control of the perceived acoustic environment (e. g. room reverberation) and of the proximity or distance of sound events.

Conventional methods for ambience extraction from stereo signals are generally based on the cross-correlation between the left-channel and right-channel signals, and as such are not readily applicable to the higher-order case here, where it is necessary to extract ambience from an arbitrary multichannel input. A multichannel ambience extraction algorithm which meets the needs of the primary-ambient spatial coder is presented in this section.

In the SAC framework, all of the input signals are first transformed to the STFT domain as described earlier. Then, the signal in a given subband k of a channel m can be thought of as a time series, i.e. a vector in time:

$$\vec{x}_m[k,l] = \begin{bmatrix} X_m[k,l] \\ X_m[k,l-1] \\ X_m[k,l-2] \\ \vdots \end{bmatrix}$$

The various channel vectors can then be accumulated into a signal matrix:

$$X[k,l]=[\vec{x}_1[k,l]\ \vec{x}_2[k,l]\ \vec{x}_3[k,l]\ \ldots\ \vec{x}_M[k,l]]$$

We can think of the signal matrix as defining a subspace. The channel vectors are one basis for the subspace. Other bases can be derived so as to meet certain properties. For a primary-ambient decomposition, a desirable property is for the basis to provide a coordinate system which separates the commonalities and the differences between the channels. The idea, then, is to first find the vector v which is most like the set of channel vectors; mathematically, this amounts to finding the vector which maximizes $\vec{v}^H XX^H \vec{v}$, which is the sum of the magnitude-squared correlations between $\vec{v}$ and the channel signals. The large cross-channel correlation is indicative of a primary or direct component, so we can separate each channel into primary and ambient components by projecting onto this vector $\vec{v}$ as in the following equations:

$$\vec{b}_m[k,l] = (\vec{v}^H \vec{x}_m[k,l])\vec{v}$$

$$\vec{a}_m[k,l] = \vec{x}_m[k,l] - \vec{b}_m[k,l].$$

The projection $\vec{b}_m[k,l]$ is the primary component. The difference $\vec{a}_m[k,l]$, or residual, is the ambient component. Note that by definition the primary and ambient components add up to the original, so no signal information is lost in this decomposition.

One way to find the vector $\vec{v}$ is to carry out a principal components analysis (PCA) of the matrix X. This is done by computing a singular value decomposition (SVD) of $XX^H$. The SVD finds a representation of a matrix in terms of two orthogonal bases (U and V ) and a diagonal matrix S:

$$XX^H = USV^H. \tag{16}$$

Since $XX^H$ is symmetric, U=V . It can be shown that the column of V with the largest corresponding diagonal element (or singular value) in S is the optimal choice for the primary vector $\vec{v}$. Once $\vec{v}$ is determined, equations (14) and (15) can be used to compute the primary and ambient signal components.

Once the signal has been decomposed into primary and ambient components, either via the aforementioned PCA algorithm or by some other suitable method, each component is analyzed for spatial information.

Spatial Analysis—Ambient

After the primary-ambient separation is carried out using the decomposition process described earlier, the primary components are analyzed for spatial information using the modified Gerzon vector scheme described earlier also. The analysis of the ambient components does not require the modifications, however, since the ambience is (by definition) not an on-the-circle sound event; in other words, the encoding locus limitations of the standard Gerzon vector do not have a significant effect for ambient components. Thus, in one embodiment we simply use the standard formulation given in Eqs. (1)-(2) to derive the ambient spatial cues from the ambient signal components. While in many cases we expect (based on typical sound production techniques) the ambient components not to have a dominant direction (r=0), any directionality of the ambience components can be represented by these direction vectors. Treating the ambient component separately improves the generality and robustness of the SAC system.

Downmix

Various downmix schemes for spatial audio coding have been proposed in the literature; early systems were based on a mono downmix, and later extensions incorporated stereo downmix for compatible playback on legacy stereo reproduction systems. Some recent methods allow for a custom downmix to be provided in conjunction with the multichannel input; the spatial side information then serves as a map from the custom downmix to the multichannel signal. In this section, we describe three downmix options for the spatial audio coding system: mono, stereo, and guided stereo. These are intended to be illustrative and not limiting.

The proposed spatial audio coder can operate effectively with a mono downmix signal generated as a direct sum of the input channels. To counteract the possibility of frequency-dependent signal cancellation (or amplification) in the downmix, dynamic equalization is preferably applied. Such equalization serves to preserve the signal energy and balance in the downmix. Without the equalization, the downmix is given by $$T[k, l] = \sum_{i=1}^{M} X_i[k, l] \tag{17}$$

The power-preserving equalization incorporates a signal-dependent scale factor:

$$T[k, l] = \sum_{m=1}^{M} X_i[k, l] \frac{\left(\sum_{i=1}^{M} |X_i[k, l]|^2\right)^{\frac{1}{2}}}{\left|\sum_{j=1}^{M} X_j[k, l]\right|} \tag{18}$$

If such an equalizer is used, each tile in the downmix has the same aggregate power as each tile in the input audio scene. Then, if the synthesis is designed to preserve the power of the downmix, the overall encode-decode process will be power-preserving.

Though robust spatial audio coding performance is achievable with a monophonic downmix, the applications are somewhat limited in that the downmix is not optimal for playback on stereo systems. To enable compatibility of spatially encoded material with stereo playback systems not equipped to decode and process the spatial cues, a stereo downmix is provided in one embodiment. In some embodiments, this downmix is generated by left-side and right-side sums of the input channels, and preferably with equalization similar to that described above. In a preferred embodiment, however, the input configuration is analyzed for left-side and right-side contributions.

While an acceptable direct downmix can be derived, it does not specifically satisfy the design goal of preserving spatial cues in the stereo downmix; directional cues may be compromised due to the input channel format or the mixing operation. In an alternate embodiment which preserves the cues, at least to the extent possible in a two-channel signal, the spatial cues extracted from the multichannel analysis are used to synthesize the downmix; in other words, the spatial synthesis described below is applied with a two-channel output configuration to generate the downmix. The frontal cues are maintained in this guided downmix, and other directional cues are folded into the frontal scene.

Synthesis

The synthesis engine of a spatial audio coding system applies the spatial side information to the downmix signal to generate a set of reproduction signals. This spatial decoding process amounts to synthesis of a multichannel signal from the downmix; in this regard, it can be thought of as a guided upmix. In accordance with this embodiment, a method is provided for the spatial decode of a downmix signal based on universal spatial cues. The description provides details as to a spatial decode or synthesis based on a downmixed mono signal but the scope of the invention can be extended to include the synthesis from multichannel signals including at least stereo downmixed ones. The synthesis method detailed here is one particular solution; it is recognized that other methods could be used for faithful reproduction of the universal spatial cues described earlier, for instance binaural technologies or Ambisonics.

Given the downmix signal T[k, 1] and the cues r[k, 1] and θ[k, 1], the goal of the spatial synthesis is to derive output signals $Y_n$[k, 1] for N speakers positioned at angles $\theta_n$ so as to recreate the input audio scene represented by the downmix and the cues. These output signals are generated on a per-tile basis using the following procedure. First, the output channels adjacent to θ[k, 1] are identified. The corresponding channel vectors $\vec{q}_i$ and $\vec{q}_j$, namely unit vectors in the directions of the i-th and j -th output channels, are then used in a vector-based panning method to derive pairwise panning coefficients $\sigma_i$ and $\sigma_j$; this panning is similar to the process described in Eq. (10). Here, though, the resulting panning vector $\vec{\sigma}$ is scaled such that $\|\vec{\sigma}\|1=1$. These pairwise panning coefficients capture the angle cue θ[k, 1]; they represent an on the-circle point, and using these coefficients directly to generate a pair of synthesis signals renders a point source at θ[k, 1] and r=1. Methods other than vector panning, e.g. sin/cos or linear panning, could be used in alternative embodiments for this pairwise panning process; the vector panning constitutes the preferred embodiment since it aligns with the pairwise projection carried out in the analysis and leads to consistent synthesis, as will be demonstrated below.

To correctly render the radial position of the source as represented by the magnitude cue r[k, 1], a second panning is carried out between the pairwise weights a and a non-directional set of panning weights, i.e. a set of weights which render a non-directional sound event over the given output configuration. Denoting the non-directional set by $\vec{\delta}$, the overall weights resulting from a linear pan between the pairwise weights and the non-directional weights are given by $$\vec{\beta} = r\vec{\sigma} + (1-r)\vec{\delta}. \tag{19}$$

This panning approach preserves the sum of the panning weights:

$$\|\vec{\beta}\|_1 = \sum_n \beta_n = r\|\vec{\sigma}\|_1 + (1-r)\|\vec{\delta}\|_1 = r + (1-r) = 1 \tag{20}$$

Under the assumption that these are energy panning weights, this linear panning is energy-preserving. Other panning methods could be used at this stage, for example:

$$\vec{\beta} = r\vec{\sigma} + (1-r)^{\frac{1}{2}}\vec{\delta} \tag{21}$$

but this would not preserve the power of the energy-panning weights. Once the panning vector $\vec{\beta}$ is computed, the synthesis signals can be generated by amplitude-scaling and distributing the mono downmix accordingly.

Figure 9:
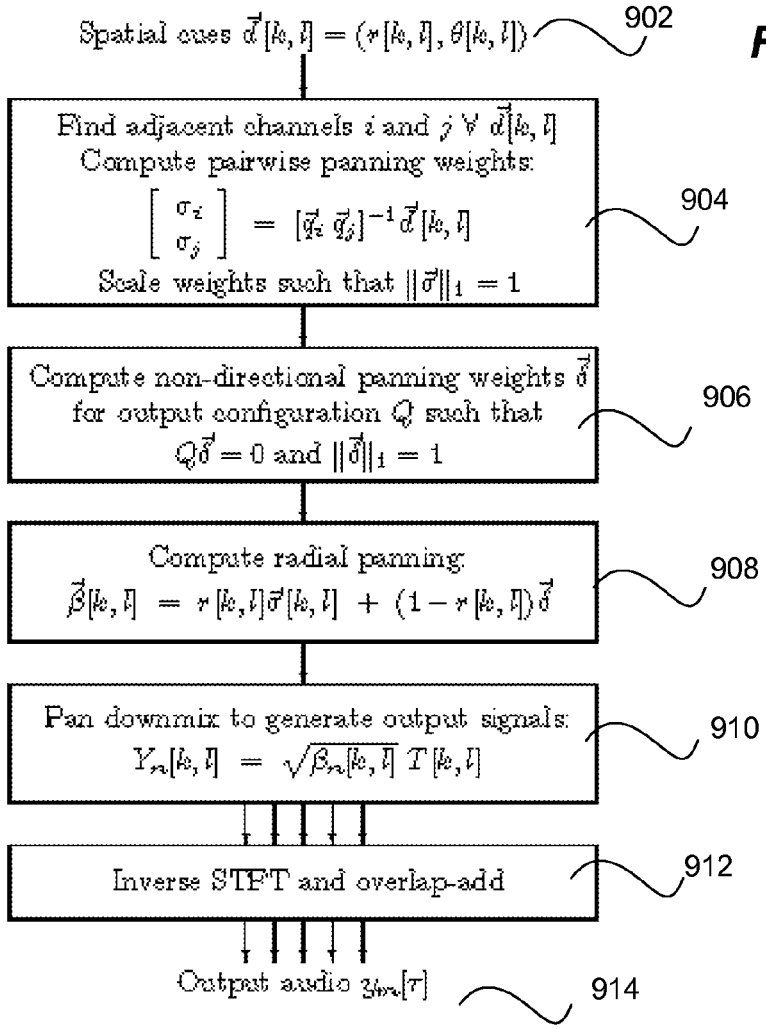
FIG. 9 is a flow chart of the synthesis procedure used in a spatial audio decoder in accordance with one embodiment of the present invention.

A flow chart of the synthesis procedure in accordance with one embodiment of the present invention is provided in FIG. 9. The process commences with the receipt of spatial cues in operation 902. At operation 904, adjacent output channels i and j are identified. Pairwise panning weights are computed and scaled such that their sum is equal to 1. These are energy weights. The pairwise coefficients enable rendering at the correct angle. Next, in operation 906, non-directional panning weights are computed for the output configuration such that the weight vector is in the null space of the matrix Q (whose columns are the unit channel vectors corresponding to the output configuration). In operation 908, radial panning is computed to enable rendering of sounds that are not positioned on the listening circle, i.e. that are situated inside the circle. In operation 910, the downmix panning is performed to generate the synthesis signals; this panning distributes the downmix signal over the output configuration. In operation 912 an inverse STFT is performed and the output audio generated at operation 914.

The consistency of the synthesized scene can be verified by considering a directional analysis based on the output format matrix, denoted by Q. The Gerzon vector for the synthesized scene is given by $$\vec{g}_s = Q\vec{\beta} = rQ\vec{\sigma} + (1-r)Q\vec{\delta}. \tag{23}$$

This corresponds to the analysis decomposition in Eq. (9); by construction, $rQ\vec{\sigma}$ is the pairwise component and $(1-r)Q\vec{\delta}$ is the non-directional component. Since $Q\vec{\delta}=0$, we have $$\vec{g}_s = rQ\vec{\sigma} \tag{24}$$

We see here that $r\vec{\sigma}$ corresponds to the $\vec{\rho}$ pairwise vector in the analysis decomposition. Rescaling the Gerzon vector according to Eq. (11) we have:

$$\vec{d}_s = \|r\vec{\sigma}\|_1 \left( \frac{\vec{g}_s}{\|\vec{g}_s\|} \right) = r \left( \frac{\vec{g}_s}{\|\vec{g}_s\|} \right)$$

This direction vector has magnitude r, verifying that the synthesis method preserves the radial position cue; the angle cue is preserved by the pairwise-panning construction of $\vec{\sigma}$.

The flexible rendering approach described above yields a synthesized scene which is perceptually and mathematically consistent with the input audio scene; the universal spatial cues estimated from the synthesized scene indeed match those estimated from the input audio. The proposed spatial cues, then, satisfy the consistency constraint discussed earlier.

If source elevation angles are incorporated in the set of spatial cues, the rendering can be extended by considering three-dimensional panning techniques, where the vectors $\vec{p}_m$ and $\vec{q}_n$ are three-dimensional. If such three-dimensional cues are used in the spatial side information but the synthesis system is two-dimensional, the third dimension can be realized using virtual speakers.

Deriving Non-Directional Weights for Arbitrary Output Formats

In the spatial synthesis described earlier, a set of non-directional weights is needed for the radial panning, i.e. for rendering in-the-circle events. In one embodiment, we derive such a set $\vec{\delta}$ with $Q\vec{\delta}=0$, where Q is again the output format matrix, by carrying out a 20 constrained optimization. The constraints are given by $Q\vec{\delta}=0$, which can be written explicitly as $$\sum_{i=1}^{N} \delta_i \cos\theta_i = 0 \tag{1}$$

$$\sum_{i=1}^{N} \delta_i \sin\theta_i = 0 \tag{2}$$

where $\theta_i$ is the i-th output speaker or channel angle. For non-directional excitation, the weights $\delta_i$ should be evenly distributed among the elements; this can be achieved by keeping the values all close to a nominal value, e.g. by minimizing a cost function $$J(\vec{\delta}) = \sum_{i=1}^{N} (\delta_i - 1)^2. \tag{3}$$

It is also necessary that the weights be non-negative (since they are panning weights). Minimizing the above cost function does not guarantee positivity for all formats; in degenerate cases, however, negative weights can be zeroed out prior to panning.

The constrained optimization described above can be carried out using the method of Lagrange multipliers. First, the constraints are incorporated in the cost function:

$$J(\vec{\delta}) = \sum_{i=1}^{N} (\delta_i - 1)^2 + \lambda_1 \sum_{i=1}^{N} \delta_i \cos\theta_i + \lambda_2 \sum_{i=1}^{N} \delta_i \sin\theta_i. \tag{4}$$

Taking the derivative with respect to $\delta_j$ and setting it equal to zero yields $$\delta_j = 1 - \frac{\lambda_1}{2}\cos\theta_j - \frac{\lambda_2}{2}\sin\theta_j. \tag{5}$$

Using this in the constraints of Eqs. (1) and (2), we have $$\begin{bmatrix} \sum_i \cos^2\theta_i & \sum_i \cos\theta_i \sin\theta_i \\ \sum_i \cos\theta_i \sin\theta_i & \sum_i \sin^2\theta_i \end{bmatrix} \begin{bmatrix} \lambda_1 \\ \lambda_2 \end{bmatrix} = 2 \begin{bmatrix} \sum_i \cos\theta_i \\ \sum_i \sin\theta_i \end{bmatrix} \tag{6}$$

We can then derive the Lagrange multipliers:

$$\begin{bmatrix} \lambda_1 \\ \lambda_2 \end{bmatrix} = \frac{2}{\Gamma} \begin{bmatrix} \sum_i \sin^2\theta_i & -\sum_i \cos\theta_i \sin\theta_i \\ -\sum_i \cos\theta_i \sin\theta_i & \sum_i \cos^2\theta_i \end{bmatrix} \begin{bmatrix} \sum_i \cos\theta_i \\ \sum_i \sin\theta_i \end{bmatrix} \tag{7}$$

where $$\Gamma = \left(\sum_i \cos^2\theta_i\right)\left(\sum_i \sin^2\theta_i\right) - \left(\sum_i \cos\theta_i \sin\theta_i\right)^2. \tag{8}$$

The resulting values for $\lambda_1$ and $\lambda_2$ are then used in Eq. (5) to derive the weights $\vec{\delta}$, which are then normalized such that $|\vec{\delta}|_1=1$. Examples of the resulting non-directional weights are given in FIG. 14 for several output formats. Note that since the weights are only dependent on the speaker angles $\theta_i$, this computation only needs to be carried out for initialization or when the output format changes.

Cue Coding

The spatial audio coding system described in the previous sections is based on the use of time-frequency spatial cues (r[k,l],θ[k,l]). As such, the cue data comprises essentially as much information as a monophonic audio signal, which is of course impractical for low-rate applications. To satisfy the important cue compaction constraint described in Section 2.2, the cue signal is preferably simplified so as to reduce the side-information data rate in the SAC system. In this section, we discuss the use of scalable frequency band grouping and quantization to achieve data reduction without compromising the fidelity of the reproduction; these are methods to condition the spatial cues such that they satisfy the compactness constraint.

In perceptual audio coding, data reduction is achieved by removing irrelevancy and redundancy from the signal representation. Irrelevancy removal is the process of discarding signal details that are perceptually unimportant; the signal data is discretized or quantized in a way that is largely transparent to the auditory system. Redundancy refers to repetitive information in the data; the amount of data can be reduced losslessly by removing redundancy using standard information coding methods known to those of ordinary skill in the relevant arts and hence will not be described in detail here.

In the spatial audio coding system, cue data reduction by irrelevancy removal is achieved in two ways: by frequency band grouping and by quantization. FIG. 10 illustrates raw and data-reduced spatial cues in accordance with one embodiment of the present invention. Depicted are examples of spatial cues at various rates: FIG. 10A: Raw high-resolution cue data; FIG. 10B: Compressed cues: 50 bands, 6 angle bits and 5 radius bits. The data rate for this example is 29.7 kbps, which can be losslessly reduced to 15.8 kbps if entropy coding is incorporated.

It should be noted that the frequency band grouping and data quantization methods enable scalable compression of the spatial cues; it is straightforward to adjust the data rate of the coded cues. Furthermore, in one embodiment a high-resolution cue analysis can inform signal-adaptive adjustments of the frequency band and bit allocations, which provides an advantage over using static frequency bands and/or bit allocations.

In the frequency band grouping, substantial data reduction can be achieved transparently by exploiting the property that the human auditory system operates on a pseudo-logarithmic frequency scale, with its resolution decreasing for increasing frequencies. Given this progressively decreasing resolution of the auditory system, it is not necessary at high frequencies to maintain the high resolution of the STFT used for the spatial analysis. Rather, the STFT bins can be grouped into nonuniform bands that more closely reflect auditory sensitivity. One way to establish such a grouping is to set the bandwidth of the first band $f_0$ and a proportionality constant A for widening the bands as the frequency increases. Then, a set of band edges can be determined as $$f_{\kappa+1}=f_\kappa(1+\Delta) \tag{26}$$

Given the band edges, the STFT bins are grouped into bands; we will denote the band index by κ and the set of sequential STFT bins grouped into band κ by Bκ. Then, rather than using the STFT magnitudes to determine the weights in Eq. (1), we use a composite value for the band $$\alpha_m[\kappa, l] = \frac{\sum_{k\in B_\kappa} |X_m[k, l]|^2}{\sum_{i=1}^{M}\sum_{k\in B_\kappa} |X_i[k, l]|^2} \tag{27}$$

This approach is based on energy preservation, but other aggregation or averaging methods may also be employed. Once the band values $\alpha_m[k,l]$ have been computed, the spatial analysis is carried out at the resolution of these frequency bands rather than at the higher resolution of the input STFT. Computing and coding the spatial cues at this lower resolution leads to significant data reduction; by reducing the frequency resolution of the cues using such a grouping, more than an order of magnitude of data reduction can be realized without compromising the spatial fidelity of the reproduction.

Note that the two parameters $f_0$ and Δ in Eq. (26) can be used to easily scale the number of frequency bands and the general band distribution used for the spatial analysis (and hence the cue irrelevancy reduction). Other approaches could be used to compute the spatial cues at a lower resolution; for instance, the input signal could be processed using a filter bank with nonuniform subbands rather than an STFT, but this would potentially entail sacrificing the straightforward band scalability provided by the STFT.

After the (r[k,l],θ[k,l]) cues are estimated for the scalable frequency bands, they can be quantized to further reduce the cue data rate. There are several options for quantization: independent quantization of r[k,l] and θ[k,l] using uniform or nonuniform quantizers; or, joint quantization based on a polar grid. In one embodiment, independent uniform quantizers are employed for the sake of simplicity and computational efficiency. In another embodiment, polar vector quantizers are employed for improved data reduction.

Embodiments of the present invention are advantageous in providing flexible multichannel rendering. In channel-centric spatial audio coding approaches, the configuration of output speakers is assumed at the encoder; spatial cues are derived for rendering the input content with the assumed output format. As a result, the spatial rendering may be inaccurate if the actual output format differs from the assumption. The issue of format mismatch is addressed in some commercial receiver systems which determine speaker locations in a calibration stage and then apply compensatory processing to improve the reproduction; a variety of methods have been described for such speaker location estimation and system calibration.

The multichannel audio decoded from a channel-centric SAC representation could be processed in this way to compensate for output format mismatch. However, embodiments of the present invention provide a more efficient system by integrating the calibration information directly in the decoding stage and thereby eliminating the need for the compensation processing. Indeed, the problem of the output format is addressed directly by the inventive framework: given a source component (tile) and its spatial cue information, the spatial decoding can be carried out to yield a robust spatial image for the given output configuration, be it a multichannel speaker system, headphones with virtualization, or any spatial rendering technique.

Figure 11:
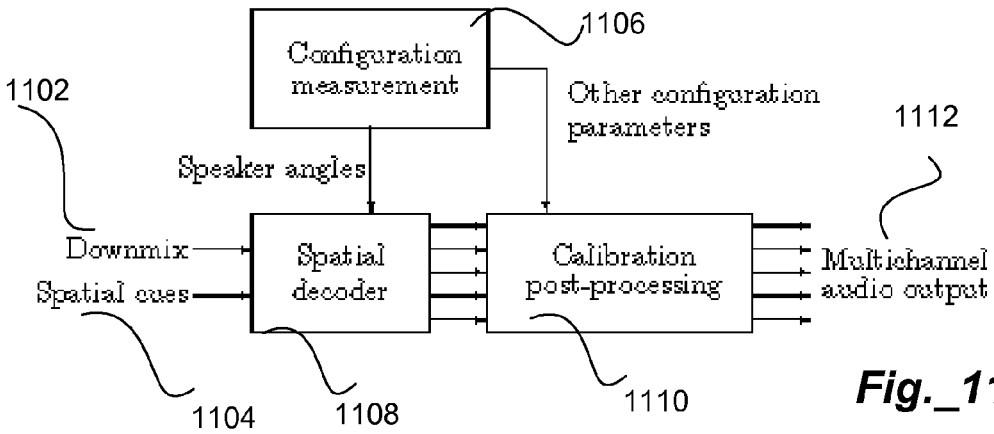
FIG. 11 is a diagram illustrating an automatic speaker configuration measurement and calibration system used in conjunction with a spatial decoder in accordance with one embodiment of the present invention.

FIG. 11 is a diagram illustrating an automatic speaker configuration measurement and calibration system used in conjunction with a spatial decoder in accordance with one embodiment of the present invention. In the figure, the configuration measurement block 1106 provides estimates of the speaker angles to the spatial decoder; these angles are used by the decoder 1108 to derive the output format matrix Q used in the synthesis algorithm. The configuration measurement depicted also includes the possibility of providing other estimated parameters (such as loudspeaker distances, frequency responses, etc.) to be used for per-channel response correction in a post-processing stage 1110 after the spatial decode is carried out.

Given the growing adoption of multichannel listening systems in home entertainment setups, algorithms for enhanced rendering of stereo content over such systems is of great commercial interest. The spatial decoding process in SAC systems is often referred to as a guided upmix since the side information is used to control the synthesis of the output channels; conversely, a non-guided upmix is tantamount to a blind decode of a stereo signal. It is straightforward to apply the universal spatial cues described herein for 2-to-N upmixing. Indeed, for the case M=2 and N >2, the M-to-N SAC system of FIG. 15 is simply a 2-to-N upmix with an optional intermediate transmission channel. In such upmix schemes, the frontal imaging is preserved and indeed stabilized for rendering over standard multichannel speaker layouts. If front-back information is phase-amplitude encoded in the original 2-channel stereo signal, side and rear content can also be identified and robustly rendered using a matrix-decode methodology. Specifically, the spatial cue analysis module of FIG. 15 (or the primary cue analysis module of FIG. 3) can be extended to determine both the inter-channel phase difference and the inter-channel amplitude difference for each time-frequency tile and convert this information into a spatial position vector describing all locations within the circle, in a manner compatible with the behavior of conventional matrix decoders. Furthermore, ambience extraction and redistribution can be incorporated for enhanced envelopment.

In accordance with another embodiment, the localization information provided by the universal spatial cues can be used to extract and manipulate sources in multichannel mixes. Analysis of the spatial cue information can be used to identify dominant sources in the mix; for instance, if many of the angle cues are near a certain fixed angle, then those can be identified as corresponding to the same discrete original source. Then, these clustered cues can be modified prior to synthesis to move the corresponding source to a different spatial location in the reproduction. Furthermore, the signal components corresponding to those clustered cues could be amplified or attenuated to either enhance or suppress the identified source. In this way, the spatial cue analysis enables manipulation of discrete sources in multichannel mixes.

In the encode-decode scenario, the spatial cues extracted by the analysis are recreated by the synthesis process. The cues can also be used to modify the perceived audio scene in one embodiment of the present invention. For instance, the spatial cues extracted from a stereo recording can be modified so as to redistribute the audio content onto speakers outside the original stereo angle range. An example of such a mapping is:

$$\hat{\theta} = \theta\left(\frac{\hat{\theta}_0}{\theta_0}\right) |\theta| \le \theta_0 \tag{28}$$

$$\hat{\theta} = \mathrm{sgn}(\theta)\left[\hat{\theta}_0 + (|\theta| - \theta_0)\left(\frac{\pi - \hat{\theta}_0}{\pi - \theta_0}\right)\right] \quad |\theta| > \theta_0 \tag{29}$$

where the original cue θ is transformed to the new cue θ based on the adjustable parameters $\theta_0$ and $\hat{\theta}_0$. The new cues are then used to synthesize the audio scene. On a typical loudspeaker setup, the effect of this particular transformation is to spread the stereo content to the surround channels so as to create a surround or "wrap-around" effect (which falls into the class of "active upmix" algorithms in that it does not attempt to preserve the original stereo frontal image). An example of this transformation with $\theta_0$=30° and $\hat{\theta}_0$=60° is shown in FIG. 12; note that other transformations could be used to achieve the widening effect, for instance a smooth function instead of a piecewise linear function.

The modification described above is another indication of the rendering flexibility enabled by the format-independent spatial cues. Note that other modifications of the cues prior to synthesis may also be of interest.

Figure 13:
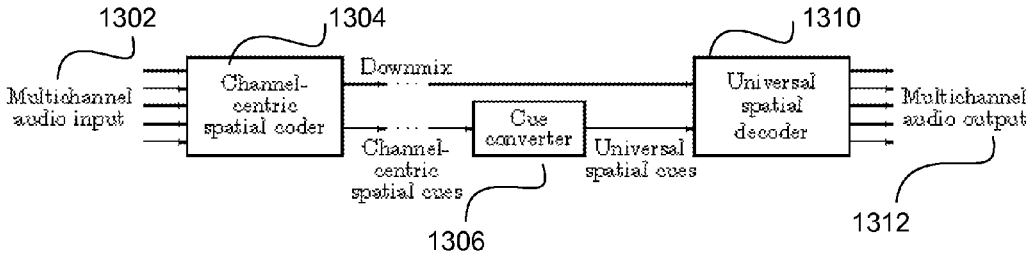
FIG. 13 is a block diagram of a system which incorporates conversion of inter-channel spatial cues to universal spatial cues in accordance with one embodiment of the present invention.

To enable flexible output rendering of audio encoded with a channel-centric SAC scheme, the channel-centric side information in one embodiment is converted to universal spatial cues before synthesis. FIG. 13 is a block diagram of a system which incorporates conversion of inter-channel spatial cues to universal spatial cues in accordance with one embodiment of the present invention. That is, the system incorporates a cue converter 1306 to convert the spatial side information from a channel-centric spatial audio coder into universal spatial cues. In this scenario, the conversion must assume that the input 1302 has a standard spatial configuration (unless the input spatial context is also provided as side information, which is typically not the case in channel-centric coders). In this configuration, the universal spatial decoder 1310 then performs decoding on the universal spatial cues.

Figures 14A, 14B, 14C:
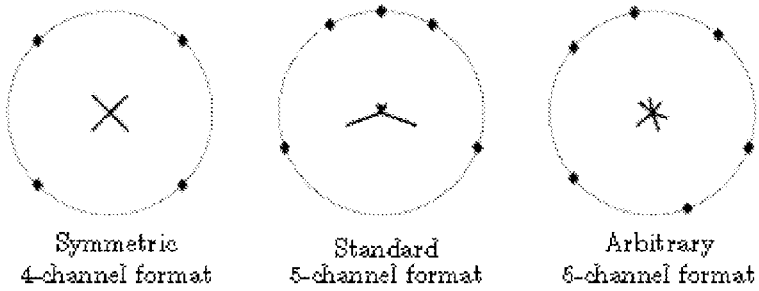
FIG. 14 is a diagram illustrating output formats and corresponding non-directional weightings derived in accordance with one embodiment of the present invention.

FIG. 14 is a diagram illustrating output formats and corresponding non-directional weightings derived in accordance with one embodiment of the present invention.

Alternate Derivation of Spatial Cue Radius

Earlier, the time-frequency direction vector $$\vec{d} = |\vec{\rho}|_1\left(\frac{\vec{g}}{|\vec{g}|}\right) \tag{9}$$

was proposed as a spatial cue to describe the angular direction and radial location of a time-frequency tile. The radius $\|\vec{\rho}\|_1$ was derived based on the desired behavior for the limiting cases of pairwise-panned and non-directional sources, namely r=1 for pairwise-panned sources and r=0 for non-directional sources. Here, we derive the radial cue by a mathematical optimization based on the synthesis model, in which the energy-panning weights for synthesis are derived by a linear pan between a set of pairwise-panning coefficients and a set of non-directional weights; the equation is restated here using the same analysis notation:

$$\vec{\alpha} = r\vec{\rho} + (1-r)\vec{\epsilon}. \tag{10}$$

The analysis notation is used since the idea is to find a decomposition of the analysis data which fits the synthesis model. We can establish several constraints for the terms in Eq. (10). First, the panning weight vectors must each be energy-preserving, i.e. must sum to one:

$$\|\vec{\alpha}\|_1 = \Sigma_m \alpha_m = 1 \tag{11}$$

$$\|\vec{\rho}\|_1 = \Sigma_m \rho_m = 1 \tag{12}$$

$$\|\vec{\epsilon}\|_1 = \Sigma_m \epsilon_m = 1 \tag{13}$$

These conditions can also be written using an M×1 vector of ones $\vec{u}$:

$$\vec{u}^T\vec{\alpha} = 1 \tag{14}$$

$$\vec{u}^T\vec{\rho} = 1 \tag{15}$$

$$\vec{u}^T\vec{\epsilon} = 1 \tag{16}$$

Note that the condition on $\vec{\alpha}$ is satisfied by definition given the normalization in Eq. (10). With respect to $\vec{\rho}$ (the pairwise-panning weights), in this approach the definition differs from that described earlier in the specification, where $\vec{\rho}$ is not normalized to sum to one. A further constraint is that $\vec{\rho}$ have only two non-zero elements; we can write $$\vec{\rho} = J_{ij}\vec{\rho}_{ij} = J_{ij}\begin{bmatrix}\rho_i \\ \rho_j\end{bmatrix} \tag{17}$$

where $J_{ij}$ is an M×2 matrix whose first column has a one in the i-th row and is otherwise zero, and whose second column has a one in the j-th row and is otherwise zero. The matrix $J_{ij}$ simply expands the two-dimensional vector $\vec{\rho}_{ij}$ to M dimensions by putting $\rho_i$ in the i-th position, $\rho_j$ in the j-th position, and zeros elsewhere. The indices i and j are selected as described earlier by finding the inter-channel arc which includes the angle of the Gerzon vector $\vec{g}=P\vec{\alpha}$, where P is the matrix of input channel vectors (the input format matrix). Note that we can also write $$\vec{\rho}_{ij}=J_{ij}^T\vec{\rho}. \tag{18}$$

A final constraint is that the non-directional weights $\vec{\epsilon}$ satisfy $$P\vec{\epsilon}=0. \tag{19}$$

In linear algebraic terms, $\vec{\epsilon}$ is in the null space of P.

The first step in the derivation is to multiply Eq. (10) by P, yielding:

$$P\vec{\alpha} = rP\vec{\rho} + (1-r)P\vec{\varepsilon} \tag{20}$$

$$= rP\vec{\rho} \tag{21}$$

where the constraint $P\vec{\epsilon}=0$ was used to simplify the equation. Since $\vec{\rho}=J_{ij}\vec{\rho}_{ij}$, we can write:

$$P\vec{\alpha}=rP\vec{\rho}=rPJ_{ij}\vec{\rho}_{ij}. \tag{22}$$

Considering the term $P_{ij}$, we see that this matrix multiplication selects the i-th and j-th columns of P, resulting in a matrix $$P_{ij}=[\vec{p}_i\ \vec{p}_j], \tag{23}$$

so we have $$P\vec{\alpha}=rP_{ij}\vec{\rho}_{ij}. \tag{24}$$

The matrix $P_{ij}$ is invertible (unless $\vec{p}_i$ and $\vec{p}_j$ are colinear, which only occurs for degenerate configurations), so we can write $$P_{ij}^{-1}P\vec{\alpha}=r\vec{\rho}_{ij}. \tag{25}$$

Here, we define a 2×1 vector of ones $\vec{u}$ and multiply both sides of the above equation by its transpose:

$$\vec{u}^TP_{ij}^{-1}P\vec{\alpha}=r\vec{u}^T\vec{\rho}_{ij}. \tag{26}$$

Since $|\vec{\rho}_{ij}|_1=|\vec{\rho}|_1=1$, we arrive at a result for the radius value:

$$r=\vec{u}^TP_{ij}^{-1}P\vec{\alpha}. \tag{27}$$

Equation (27) can be rewritten in terms of the Gerzon vector as $$r=\vec{u}^TP_{ij}^{-1}\vec{g}. \tag{28}$$

The matrix-vector product $P_{ij}^{-1}\vec{g}$ is the projection of the Gerzon vector onto the adjacent channel vectors as described earlier. Multiplying by $\vec{u}^T$ then computes the sum of the projection coefficients, such that r is the one-norm of the projection coefficient vector:

$$r=|P_{ij}^{-1}\vec{g}|. \tag{29}$$

This is exactly the value for r proposed in Section 4.

For the spatial audio coding system, it is not necessary to compute the panning weights $\vec{\rho}$ and $\vec{68}$(except in that $\vec{\rho}_{ij}$ is needed as an intermediate result to find r); all that is required here is an r value for the spatial cues. For the sake of completeness, though, we continue the derivation by substituting the r value in Eq. (27) into the model of Eq. (10).

This yields solutions for the panning weights that fit the synthesis model:

$$\vec{\rho} = \frac{J_{ij}P_{ij}^{-1}P\vec{\alpha}}{\vec{u}^TP_{ij}^{-1}P\vec{\alpha}} \tag{30}$$

$$[\vec{\text{epsilon}}] = \frac{\vec{\alpha} - J_{ij}P_{ij}^{-1}P\vec{\alpha}}{1-\vec{u}^TP_{ij}^{-1}P\vec{\alpha}} \tag{31}$$

which can be shown to satisfy the various conditions established earlier.

The foregoing description describes several embodiments of a method for spatial audio coding based on universal spatial cues. Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method of processing an audio input signal, the method comprising:

receiving an audio input signal;

deriving using at least one processor spatial cue information from a frequency-domain representation of the audio input signal, wherein the spatial cue information is generated by determining at least one direction vector for an audio event from the frequency-domain representation;

downmixing the audio input signal; and synthesizing a set of output signals from the downmixed signal, wherein the set of output signals is synthesized by deriving pairwise-panning weights to recreate the appropriate perceived direction indicated by the spatial cue information; deriving omnidirectional panning weights that result in a non-directional percept; and cross-fading between the pairwise-panning weights and omnidirectional panning weights to achieve the correct spatial location.

2. The method as recited in claim 1 wherein deriving spatial cue information includes assigning to each signal in an input audio scene a corresponding direction vector with a direction corresponding to the signal's spatial location and a magnitude corresponding to the signal's intensity or energy.

3. The method as recited in claim 1 wherein the direction vectors corresponding to the signals are aggregated by vector addition to yield an overall perceived spatial location for the combination of signals.

4. The method as recited in claim 1 wherein the audio input signal is part of an audio scene and the audio event is a component of the audio scene that is localized in time and frequency.

5. The method as recited in claim 1 wherein the audio event is a time-localized component of the frequency-domain representation of the audio input signal and corresponds to an aggregation of time-localized components of the frequency-domain representations of the multiple channels in the audio input signal.

6. The method as recited in claim 1 wherein the direction vectors include a radial and an angular component and are determined by assigning a direction vector to each channel of the audio input signal, scaling these channel vectors based on the corresponding channel content, and carrying out a vector summation of the scaled channel vectors.

7. The method as recited in claim 1 further comprising decomposing the audio input signal into primary and ambient components and determining a direction vector for at least the primary component.

8. The method as recited in claim 7 further comprising determining a direction vector for the ambience component.

9. The method as recited in claim 1 wherein the downmixing from the audio input signal comprises downmixing to a standard stereo format.

10. The method as recited in claim 1 wherein the synthesis is guided by a control signal based on the spatial cue information.

11. The method as recited in claim 1 further comprising automatically detecting an output speaker configuration and reconfiguring the synthesis to incorporate the determined output speaker configuration.

12. The method as recited in claim 1 further comprising encoding the spatial cue information with a data reduction technique.

13. A method of synthesizing a multichannel audio signal, the method comprising:

receiving a downmixed audio signal and spatial cues based on direction vectors, the downmixed audio signal corresponding to a multichannel audio signal;

deriving using at least one processor a frequency-domain representation for the downmixed audio signal; and distributing the downmixed audio signal to output channels of a multichannel output signal using the spatial cues, wherein the mulitchannel output signal is synthesized from the downmixed audio signal by deriving pairwise-panning weights to recreate the appropriate perceived direction indicated by the spatial cues; deriving omnidirectional panning weights that result in a non-directional percept; and cross-fading between the pairwise-panning weights and omnidirectional panning weights to achieve the correct spatial location.

14. The method as recited in claim 13 wherein the spatial cues are synthesized into the multichannel output signal by using spatial angle cue and panning a time-localized component of the frequency-domain representation of the downmixed signal.

15. The method as recited in claim 13, wherein the non-directional percept results from preserving a radial portion of the spatial cues.

16. The method as recited in claim 13 wherein the spatial location of the multichannel audio signal is synthesized using positional information regarding the rendering loudspeakers.

17. The method as recited in claim 16 further comprising automatically estimating positional information for the rendering loudspeakers and using the positional information in optimizing the distribution of the downmixed audio signal to the output channels.

18. The method as recited in claim 13 further comprising synthesizing the multichannel audio signal such that the energy of the input audio scene is preserved.

* * * * *